US005370310A

United States Patent [19]

Willan

[11] Patent Number: 5,370,310

[45] Date of Patent: * Dec. 6, 1994

[54] DEVICE FOR DIRECTING THE FLOW OF AN ATOMIZED SLURRY

[76] Inventor: W. Craig Willan, P.O. Box 574, Hurst, Tex. 76053

[ * ] Notice: The portion of the term of this patent subsequent to Mar. 15, 2011 has been disclaimed.

[21] Appl. No.: 196,513

[22] Filed: Feb. 14, 1994

Related U.S. Application Data

[62] Division of Ser. No. 895,781, Jun. 9, 1992, Pat. No. 5,294,059.

[51] Int. Cl.[5] ..... B05B 3/02

[52] U.S. Cl. ..... 239/224; 239/591

[58] Field of Search ..... 239/590, 591, 590.3, 239/590.5, 224

[56] References Cited

U.S. PATENT DOCUMENTS

| | | | |
|---|---|---|---|
| 3,273,805 | 9/1966 | Hall | 239/590.3 |
| 3,510,065 | 5/1970 | Gigantino et al. | 239/590.3 X |
| 4,121,770 | 10/1978 | Starrup et al. | 239/591 X |
| 4,793,426 | 12/1988 | Millsapps | 239/591 X |
| 4,794,995 | 1/1989 | Matson et al. | 239/600 X |
| 5,086,974 | 2/1992 | Henshaw | 239/500 X |

*Primary Examiner*—Andres Kashnikow
*Assistant Examiner*—Kevin P. Weldon
*Attorney, Agent, or Firm*—James E. Bradley

[57] ABSTRACT

A device for directing the flow of an atomized slurry from the ejection orifice of an atomizer housing which is composed of a cylindrical liner bushing made of a wear-resistant material and a cylindrical sleeve bushing designed to support the liner bushing within the ejection orifice of the atomizer housing. The geometries of the liner and sleeve bushings form an annular, recessed shoulder at the discharge end of the bushings. During rotation of the atomizer, turbulent flow eddy currents pack slurry media into this shoulder. The liner bushing is bonded in the sleeve bushing under compression to create a residual preload opposing the centrifugal force generated by rotation of the atomizer housing.

15 Claims, 2 Drawing Sheets

DEVICE FOR DIRECTING THE FLOW OF AN ATOMIZED SLURRY

This application is a division of application Ser. No. 07/895,781, filed Jun. 6, 1992, now U.S. Pat. No. 5,294,059.

BACKGROUND OF THE INVENTION

1. Field of the Invention

This invention relates generally to devices for directing the flow of a highly abrasive, atomized slurry from the ejection orifice of an atomizer housing.

2. Summary of the Prior Art

Nozzles for directing the flow of a highly abrasive, atomized slurry from the ejection orifice of an atomizer are well known in the art. These nozzles are typically made of a wear-resistant sintered material such as tungsten carbide, silicone carbide, aluminum oxide, and tetraboric carbide. Although these materials tolerate purely compressive stress, they perform poorly when exposed to tensile or bending stresses. Therefore, various geometries have been employed in an attempt to minimize nozzle cracking caused by the tensile stresses generated by the high centrifugal forces present during atomizer operation.

Three zones of nozzle wear due to atomizer operation are typically observed. First, wear occurs at the inlet of the nozzle due to the circumferential impact of the relatively low velocity slurry media with the high angular velocity nozzle. Second, guide tube wear occurs due to the parallel or laminar flow of the slurry media along the inside surface of the nozzle. Finally, exit wear occurs due to the turbulent flow conditions of the slurry media at the point of flow exit from the nozzle. Exit wear creates performance problems due to the fact that geometrical changes in the flow exit of the nozzle tend to affect the atomizer spray efficiency.

U.S. Pat. No. 3,454,226, Jul. 8, 1969, to Nielsen discloses an atomizer wheel with tapered, semi-cylindrical bushings made from a wear-resistant sintered material configured for mounting within the ejection orifices of the atomizer wheel. These bushings are secured within the ejection orifice solely by the radially outward directed centrifugal forces caused by the operation of the atomizer. The '226 patent teaches that the use of a purely cylindrical bushing results in excessive wear of the inner surface of the ejection orifice where the orifice contacts the outer surface of the bushing. The '226 patent also discloses tapered bushings of a sintered wear-resistant material having a square cross section.

U.S. Pat. No. 3,640,467, Feb. 8, 1972, to Moller, et al. discloses a tapered, semi-cylindrical liner bushing made from a wear-resistant sintered material fitting into a cylindrical sleeve bushing which is configured to mount in the ejection orifice of an atomizer. The '467 patent also discloses a cylindrical sleeve bushing capable of supporting a liner bushing with the shape of an elliptical generatrix. The '467 patent also teaches a prestressing of the cylindrical sleeve bushing through a cooling process to induce a residual, compressive hoop stress on the elliptical generatrix liner bushing. This prestressing allows the liner bushing to better withstand the tensile hoop stress produced by the centrifugal force created by the atomizer operation.

U.S. Pat. No. 3,887,133, Jun. 3, 1975, to Straarup, et al. and U.S. Pat. No. 4,121,770, Oct. 24, 1978, to Straarup, et al. both disclosed a tapered, semi-cylindrical liner bushing supported by a cylindrical sleeve bushing in the ejection orifice of an atomizer. The bushings of the '133 and '770 patents are substantially identical to the bushings disclosed in the '467 patent.

Even though the prior art has proposed various geometrical, material, and manufacturing solutions to the problem of atomizer nozzle wear caused by abrasive slurry media, atomizer spray efficiency and atomizer nozzle wear life remain adversely affected by this problem.

SUMMARY OF THE INVENTION

It is a general object of the present invention to provide a device for directing the flow of an atomized slurry from an atomizer housing which exhibits a significantly reduced wear rate from previous atomizer nozzles and is not subject to the cracking problems experienced by previous atomizer nozzles. These objects directly result in an improved atomizer spray efficiency and a longer atomizer nozzle wear life.

The present invention includes a liner bushing made from a wear-resistant material with an axial passage extending from its intake to its discharge. A sleeve bushing supports the liner bushing within an ejection orifice of an atomizer housing. The sleeve bushing has an aperture on its supporting end with a diameter greater than the discharge end of the axial passage of the liner bushing. The diameter differential between the aperture of the sleeve bushing and the discharge end of the axial passage of the liner bushing defines an annular shoulder.

During operation of the atomizer, turbulent flow eddy currents at the discharge end of the liner bushing cause slurry media to tightly pack in this shoulder. This packing establishes a new exit wear zone composed of slurry media instead of a wear-resistant material, and this zone continuously forms, compacts, and abrades during atomizer operation. This sacrificial buildup of slurry media becomes the primary wear zone of the device, and it effectively shields the sleeve bushing and the liner bushing from wear caused by the abrasive slurry media.

The sleeve bushing and the liner bushing are bonded together with a high temperature resistant, high shear strength ceramic adhesive which is cured at a selected temperature, pressure, and time. This curing process results in an axial, residual preload force in the liner bushing which opposes the centrifugal force created by atomizer operation and significantly reduces the chance of failure due to cracking.

Other objects, features, and advantages of the present invention will become apparent to one skilled in the art with reference to the following detailed description.

DETAILED DESCRIPTION OF THE INVENTION

Figure 1:
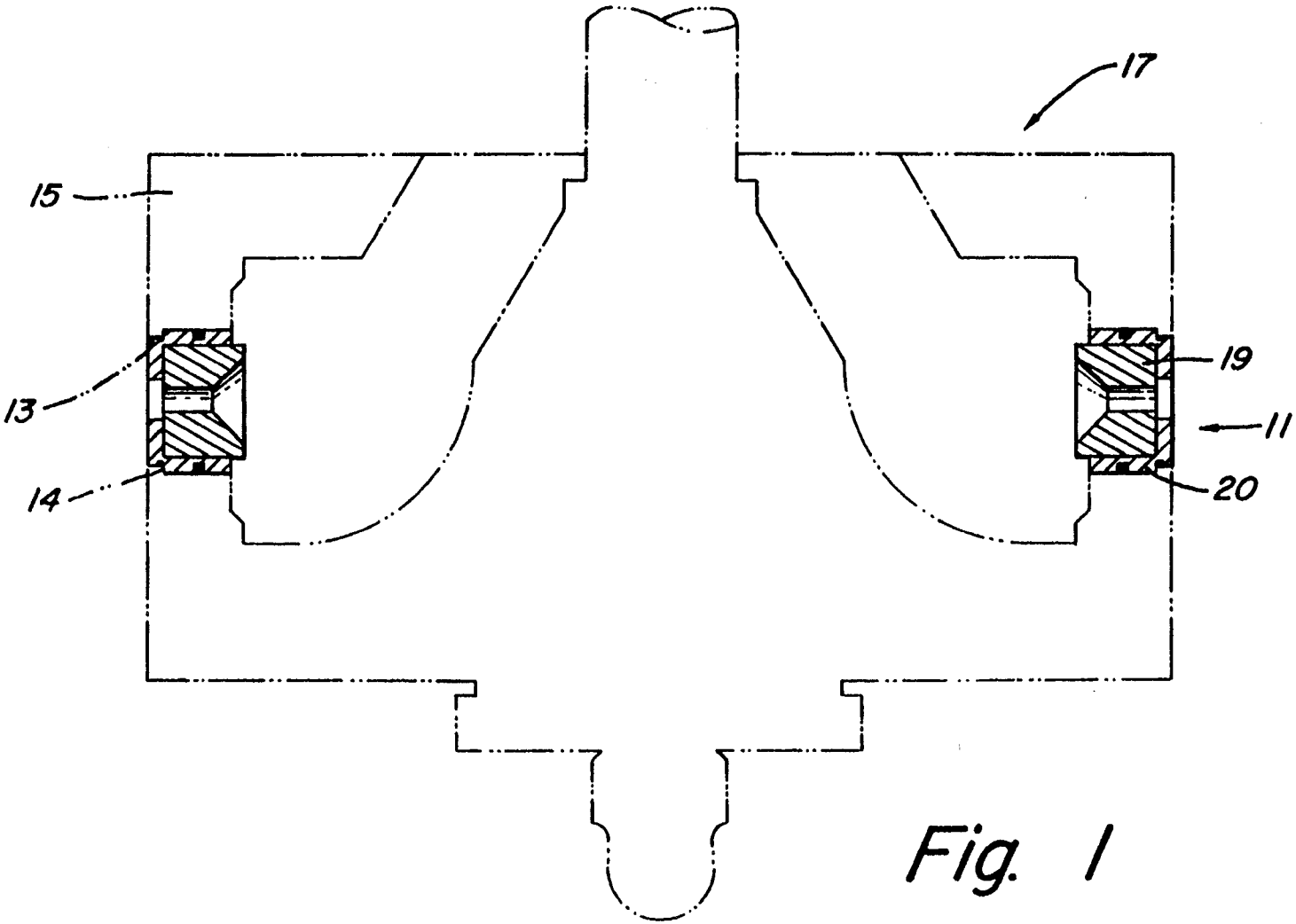
FIG. 1 is a cross-sectional view of an atomizer housing illustrated schematically by dotted lines showing the positioning of the present invention within two representative ejection orifices of the atomizer housing.
Figure 2:
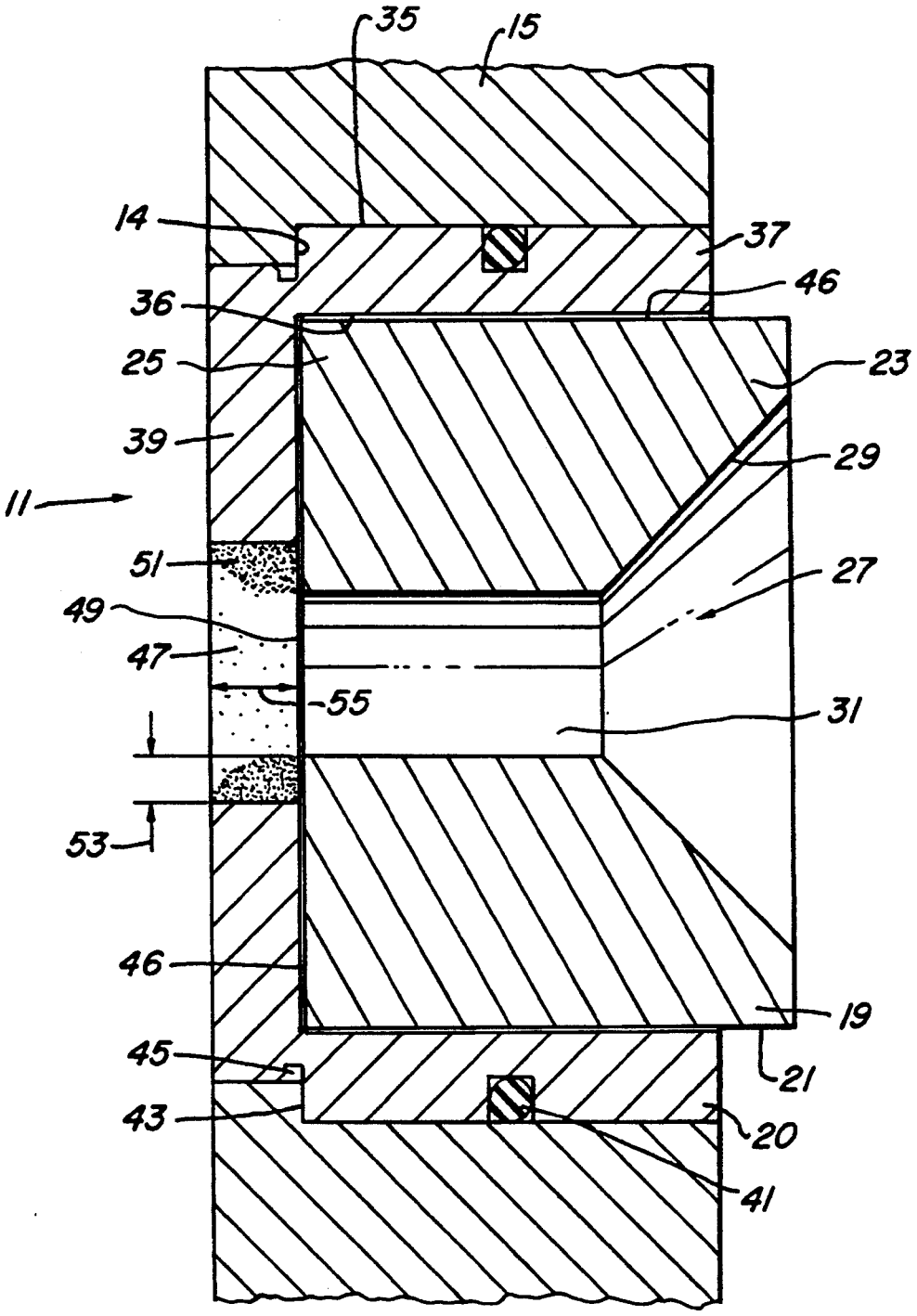
FIG. 2 is an enlarged, cross-sectional view of the present invention positioned within an ejection orifice of an atomizer housing.

FIGS. 1 and 2 illustrate an atomized slurry nozzle 11 positioned within ejection orifice 13 of housing 15 of atomizer 17 according to the present invention. Nozzle 11 is composed of two primary components, liner bushing 19 and sleeve bushing 20. Ejection orifice 13 is a cylindrical hole extending on a radial line from the axis of rotation of housing 15. Orifice shoulder 14 is located in orifice 13 and faces toward the axis of rotation of housing 15.

As shown in FIG. 2, liner bushing 19 has a cylindrical outer diameter or outer surface 21, an intake end 23, a discharge end 25, and an axial passage 27 extending from intake end 23 to discharge end 25. The axial passage 27 is composed of a conical nozzle inlet 29 beginning at intake end 23 and truncating into a cylindrical portion 31 which extends to discharge end 25. Liner bushing 19 is made of hard, wear-resistant material such as boron carbide or silicon carbide, with the exact material selection depending on the requirements of the specific atomizer and slurry.

Sleeve bushing 20 has a cylindrical outer diameter or outer surface 35, a cylindrical bore or inner surface 36, an open end 37, and a support wall 39. Outer surface 35 has O-ring groove 41 located near the mid point between open end 37 and support wall 39, an annular mounting shoulder 43 located near support wall 39 for mounting the present invention within ejection orifice 13, and stress relief groove 45 located at the apex of annular mounting shoulder 43. Mounting shoulder 43 engages orifice shoulder 14. Sleeve bushing 20 is made from a common steel such as Rockwell C 40 steel.

Open end 37 is designed to receive liner bushing 19. Liner bushing 19 and sleeve bushing 20 are assembled with a high shear strength, high temperature resistant ceramic adhesive 46 spread on the outer surface 21 of liner bushing 19, the inner surface 36 of sleeve bushing 20, the discharge end 25 of liner bushing 19, and the inner surface of support wall 39. Liner bushing 19 and sleeve bushing 20 are rigidly secured together by a curing operation at 400–800 degrees F., with a compressive, axial loading of 4,000–5,000 PSI, for 15–20 minutes. This curing operation results in support wall 39 and cylindrical bore 36 exerting a residual preload force on liner bushing 19 in a direction along the axis of liner bushing 19 and toward intake end 23.

Support wall 39 has an axial aperture 47 of a diameter greater than discharge end 25 of axial passage 27 of liner bushing 19. The greater diameter of aperture 47 over discharge end 25 of axial passage 27 defines annular discharge shoulder 49. Shoulder 49 is upstream of the outer surface of support wall 39, as shown by axial standoff length 55. During operation of atomizer 17, turbulent flow eddy currents at discharge end 25 of axial passage 27 continuously pack slurry media into annular discharge shoulder 49 and the side wall of aperture 47, forming sacrificial buildup 51.

The size of sacrificial buildup 51 is determined by radius differential 53 and axial standoff length 55. Both radius differential 53 and axial standoff length 55 must be varied proportionally with the rotational speed of atomizer 17 and the corresponding flow speed of the slurry. For an atomizer 17 with a rotational speed of 10,000–14,000 revolutions per minute yielding a slurry flow speed of 790 miles per hour, a radius differential 53 of 0.0625 inches and an axial standoff length 55 of 0.150 inches are appropriate.

The operation of the atomized slurry directing device of the present invention will now be discussed with reference to FIGS. 1 and 2. The assembled and cured atomized slurry nozzle 11, composed of liner bushing 19 and sleeve bushing 20, is placed within each ejection orifice 13 of housing 15 of atomizer 17. The nozzle 11 fits closely within ejection orifice 13 and is supported by orifice shoulder 14 and annular mounting shoulder 43. O-ring groove 41 receives a rubber O-ring to prevent any slurry from escaping the interior of housing 15 through the narrow cavity between outer surface 35 of sleeve bushing 20 and the inner surface of ejection orifice 13. When atomizer 17 begins rotating, the radially outward directed centrifugal force insures that annular mounting shoulder 43 remains secured against orifice shoulder 14 and that the O-ring in O-ring groove 41 forms an effective seal against the inner surface of ejection orifice 13.

Because of the cylindrical geometries of liner bushing 19 and sleeve bushing 20, the radially outward directed centrifugal force caused by the rotation of atomizer 17 creates a purely compressive loading on liner bushing 19 against support wall 39 of sleeve bushing 20. Therefore, the wear-resistant material of liner bushing 19 is not subjected to any tensile or bending stresses. The compressive loading is opposed by the radially inward directed residual preload force affected on liner bushing 19 by the curing process. The residual preload force is approximately twenty percent greater than the compressive loading caused by the centrifugal force generated by the rotation of atomizer 17.

As atomizer 17 begins rotating, atomized slurry travels through axial passage 27 of liner bushing 19. As the slurry leaves discharge end 25, turbulent flow eddy currents pack the slurry media against annular discharge shoulder 49 and the side wall of aperture 47, forming sacrificial buildup 51. Sacrificial buildup 51 effectively creates a new exit wear zone which continuously forms, compacts, and abrades during operation of atomizer 17.

The atomized slurry nozzle of the present invention has significant advantages. First, the nozzle geometry allows the formation of a sacrificial buildup of slurry media at its discharge end, and this sacrificial buildup greatly increases the wear life of the nozzle and maintains the atomizer spray efficiency during the lifetime of the nozzle. In addition, the geometry of the nozzle insures that the brittle, wear-resistant liner bushing is only subjected to a compressive loading by the centrifugal force caused by the atomizer rotation. The cylindrical exterior of the liner bushing eliminates all tensile and bending stresses. Because of the purely compressive loading, the chance of failure due to cracking in the wear-resistant liner bushing is greatly reduced. Finally, the axial, residual preloading of the wear-resistant liner bushing directly opposes the compressive loading created by the centrifugal force, and therefore the compressive loading on the liner bushing can be entirely eliminated or greatly reduced.

The present invention has been described with reference to a preferred embodiment. One skilled in the art will appreciate that the present invention is not thus limited and is susceptible to variations without departing from the scope of the invention.

I claim:

1. A method of constructing a nozzle, installing it an atomizer housing, and operating the atomizer housing, the atomizer housing having a cylindrical wall containing at least one ejection orifice having an ejection orifice axis, the atomizer housing being rotatable about a rotational axis that is perpendicular to the ejection orifice axis, the method comprising:

providing a liner bushing made from a wear-resistant material having an intake end, a discharge end, an outer sidewall, and an axial passage extending from the intake end to the discharge end;

providing a sleeve bushing having an axial bore and a support wall in the axial bore, the support wall having an aperture therein which has a greater diameter than the discharge end of the axial passage;

securing the liner bushing within the axial bore of the sleeve bushing with the discharge end of the liner bushing in contact with the support wall of the sleeve bushing, the greater diameter of the aperture of the support wall over the discharge end of the axial passage defining a recessed shoulder; then installing the assembled liner bushing and sleeve bushing within the ejection orifice and sealing the exterior of the sleeve bushing to the ejection orifice; then rotating the atomizer housing about the rotational axis and ejecting atomized slurry through the axial passage of the liner bushing; and causing slurry media to pack tightly on the recessed shoulder due to turbulent flow eddy currents, the packed slurry media retarding erosion of the liner bushing; and wherein the step of providing a liner bushing comprises making the outer sidewall of the liner bushing cylindrical, and the step of installing the liner bushing within the axial bore of the sleeve bushing comprises installing the liner bushing in a manner so as to be free of any hoop stress on the liner bushing when installed.

2. A method of constructing a nozzle, installing it an atomizer housing, and operating the atomizer housing, the atomizer housing having a cylindrical wall containing at least one ejection orifice having an ejection orifice axis, the atomizer housing being rotatable about a rotational axis that is perpendicular to the ejection orifice axis, the method comprising:

providing a liner bushing made from a wear-resistant material having an intake end, a discharge end, an outer sidewall, and an axial passage extending from the intake end to the discharge end;

providing a sleeve bushing having an axial bore and a support wall in the axial bore, the support wall having an aperture therein which has a greater diameter than the discharge end of the axial passage;

securing the liner bushing within the axial bore of the sleeve bushing with the discharge end of the liner bushing in contact with the support wall of the sleeve bushing, the greater diameter of the aperture of the support wall over the discharge end of the axial passage defining a recessed shoulder; then installing the assembled liner bushing and sleeve bushing within the ejection orifice and sealing the exterior of the sleeve bushing to the ejection orifice; then rotating the atomizer housing about the rotational axis and ejecting atomized slurry through the axial passage of the liner bushing; and causing slurry media to pack tightly on the recessed shoulder due to turbulent flow eddy currents, the packed slurry media retarding erosion of the liner bushing; and wherein the step of securing the liner bushing within the axial bore of the sleeve bushing comprises:

coating the outer sidewall of the liner bushing with an adhesive and placing the liner bushing within the axial bore of the sleeve bushing; then curing the adhesive.

3. A method of constructing a nozzle, installing it an atomizer housing, and operating the atomizer housing, the atomizer housing having a cylindrical wall containing at least one ejection orifice having an election orifice axis, the atomizer housing being rotatable about a rotational axis that is perpendicular to the ejection orifice axis, the method comprising:

providing a liner bushing made from a wear-resistant material having an intake end, a discharge end, an outer sidewall, and an axial passage extending from the intake end to the discharge end;

providing a sleeve bushing having an axial bore and a support wall in the axial bore, the support wall having an aperture therein which has a greater diameter than the discharge end of the axial passage;

securing the liner bushing within the axial bore of the sleeve bushing with the discharge end of the liner bushing in contact with the support wall of the sleeve bushing, the greater diameter of the aperture of the support wall over the discharge end of the axial passage defining a recessed shoulder; then installing the assembled liner bushing and sleeve bushing within the ejection orifice and sealing the exterior of the sleeve bushing to the ejection orifice; then rotating the atomizer housing about the rotational axis and ejecting atomized slurry through the axial passage of the liner bushing; and causing slurry media to pack tightly on the recessed shoulder due to turbulent flow eddy currents, the packed slurry media retarding erosion of the liner bushing; and wherein the step of securing the liner bushing within the axial bore of the sleeve bushing comprises:

coating the outer sidewall of the liner bushing with an adhesive and placing the liner bushing within the axial bore of the sleeve bushing; then pressing the liner bushing against the support wall of the sleeve bushing with a selected pressure; then while maintaining the pressure, curing the adhesive so that after the curing is completed, the support wall of the sleeve bushing exerts an axial preload force against the liner bushing directed axially along the axial bore of the sleeve bushing.

4. A method of constructing a nozzle, installing it an atomizer housing, and operating the atomizer housing, the atomizer housing having a cylindrical wall containing at least one ejection orifice having an ejection orifice axis, the atomizer housing being rotatable about a rotational axis that is perpendicular to the ejection orifice axis, the method comprising:

providing a liner bushing made from a wear-resistant material having an intake end, a discharge end, an outer sidewall, and an axial passage extending from the intake end to the discharge end;

providing a sleeve bushing having an axial bore and a support wall in the axial bore, the support wall having an aperture therein which has a greater diameter than the discharge end of the axial passage;

securing the liner bushing within the axial bore of the sleeve bushing with the discharge end of the liner bushing in contact with the support wall of the sleeve bushing, the greater diameter of the aperture of the support wall over the discharge end of the axial passage defining a recessed shoulder; then installing the assembled liner bushing and sleeve bushing within the ejection orifice and sealing the exterior of the sleeve bushing to the ejection orifice; then rotating the atomizer housing about the rotational axis and ejecting atomized slurry through the axial passage of the liner bushing; and causing slurry media to pack tightly on the recessed shoulder due to turbulent flow eddy currents, the packed slurry media retarding erosion of the liner bushing; and wherein the step of securing the liner bushing within the axial bore of the sleeve bushing comprises:

coating the outer sidewall of the liner bushing with an adhesive and placing the liner bushing within the axial bore of the sleeve bushing; then pressing the liner bushing against the support wall of the sleeve bushing with a selected pressure; then while maintaining the pressure, curing the adhesive by placing the liner bushing and the sleeve bushing in an oven at a selected temperature and time so that after the curing is completed, the support wall of the sleeve bushing exerts an axial preload force against the liner bushing directed axially along the axial bore of the sleeve bushing.

5. A method of constructing a nozzle, installing it an atomizer housing, and operating the atomizer housing, the atomizer housing having a cylindrical wall containing at least one ejection orifice having an ejection orifice axis, the atomizer housing being rotatable about a rotational axis that is perpendicular to the ejection orifice axis, the method comprising:

providing a liner bushing made from a wear-resistant material having an intake end, a discharge end, an outer sidewall, and an axial passage extending from the intake end to the discharge end;

providing a sleeve bushing having an axial bore and a support wall in the axial bore, the support wall having an aperture therein which has a greater diameter than the discharge end of the axial passage;

securing the liner bushing within the axial bore of the sleeve bushing with the discharge end of the liner bushing in contact with the support wall of the sleeve bushing, the greater diameter of the aperture of the support wall over the discharge end of the axial passage defining a recessed shoulder; then installing the assembled liner bushing and sleeve bushing within the ejection orifice and sealing the exterior of the sleeve bushing to the ejection orifice; then rotating the atomizer housing about the rotational axis and ejecting atomized slurry through the axial passage of the liner bushing; and causing slurry media to pack tightly on the recessed shoulder due to turbulent flow eddy currents, the packed slurry media retarding erosion of the liner bushing; and wherein the step of securing the liner bushing within the axial bore of the sleeve bushing comprises:

coating the outer sidewall of the liner bushing with an adhesive and placing the liner bushing within the axial bore of the sleeve bushing; then pressing the liner bushing against the support wall of the sleeve bushing with a selected pressure; then while maintaining the pressure, curing the adhesive so that after the curing is completed, the support wall of the sleeve bushing exerts an axial preload force against the liner bushing directed axially along the axial bore of the sleeve bushing that is selected to be greater than a centrifugal force generated by rotation of the atomizer housing opposite to said preload force.

6. A method of constructing a nozzle, installing it an atomizer housing, and operating the atomizer housing, the atomizer housing having a cylindrical wall containing at least one ejection orifice having an ejection orifice axis, the atomizer housing being rotatable about a rotational axis that is perpendicular to the ejection orifice axis, the method comprising:

providing a liner bushing made from a wear-resistant material having an intake end, a discharge end, an outer sidewall, and an axial passage extending from the intake end to the discharge end;

providing a sleeve bushing having an axial bore and a support wall which faces in an upstream direction;

coating the exterior of the liner bushing with an adhesive;

placing the liner bushing within the axial bore of the sleeve bushing and pressing a portion of the liner bushing into contact with the support wall of the sleeve bushing with a selected pressure acting axially along axial bore of the sleeve bushing; then while maintaining the pressure, curing the adhesive so that after the curing is completed, the support wall of the sleeve bushing exerts an axial preload force against the liner bushing directed axially along the axial bore of the sleeve bushing; then installing the assembled liner bushing and sleeve bushing within the ejection orifice and sealing the exterior of the sleeve bushing to the ejection orifice; then rotating the atomizer housing about the rotational axis and ejecting atomized slurry through the axial passage of the liner bushing.

7. The method according to claim 6 wherein the step of curing the adhesive comprises placing the liner bushing and the sleeve bushing in an oven at a selected temperature and time.

8. The method according to claim 6 wherein the axial preload force is greater than a centrifugal force generated by rotation of the atomizer housing and acting along the ejection orifice axis in a direction opposite to said preload force.

9. The method according to claim 6 wherein the selected pressure is in the range from 4,000 to 5,000 psi.

10. A method of constructing a nozzle, installing it an atomizer housing, and operating the atomizer housing, the atomizer housing having a cylindrical wall containing at least one ejection orifice having an ejection orifice axis, the atomizer housing being rotatable about a rotational axis that is perpendicular to the ejection orifice axis, the method comprising:

providing a liner bushing made from a wear-resistant material having an intake end, a discharge end, an outer sidewall, and an axial passage extending from the intake end to the discharge end;

providing a sleeve bushing having an axial bore and a support wall therein which faces in an upstream direction, the support wall having an aperture which has a greater diameter than the discharge end of the axial passage;

coating the exterior of the liner bushing with an adhesive;

placing the liner bushing within the axial bore of the sleeve bushing and pressing the discharge end of the liner bushing into contact with the support wall of the sleeve bushing with a selected pressure acting axially along axial bore of the sleeve bushing, the greater diameter of the aperture of the support wall over the discharge end of the axial passage defining a recessed shoulder; then while maintaining the pressure, curing the adhesive so that after the curing is completed, the support wall of the sleeve bushing exerts an axial preload force against the liner bushing directed axially along the axial bore of the sleeve bushing; then installing the assembled liner bushing and sleeve bushing within the ejection orifice and sealing the exterior of the sleeve bushing to the ejection orifice; then rotating the atomizer housing about the rotational axis and ejecting atomized slurry through the axial passage of the liner bushing; and causing slurry media to pack tightly on the recessed shoulder due to turbulent flow eddy currents, the packed slurry media retarding erosion of the liner bushing.

11. The method according to claim 10 wherein the step of curing the adhesive comprises placing the liner bushing and the sleeve bushing in an oven at a selected temperature and time.

12. The method according to claim 10 wherein the axial preload force is greater than a centrifugal force generated by rotation of the atomizer housing and acting along the ejection orifice axis in a direction opposite to said preload force.

13. The method according to claim 10 wherein the selected pressure is in the range from 4,000 to 5,000 psi.

14. The method according to claim 10 wherein the step of installing the assembled liner bushing and sleeve bushing in the ejection orifice comprises:

providing mating support shoulders on the sleeve bushing and in the ejection orifice of the atomizer housing and placing the support shoulder of the sleeve bushing in contact with the support shoulder in the ejection orifice, with a downstream end of the support wall substantially flush with an exterior surface of the cylindrical wall of the atomizer housing, and with the recessed shoulder spaced upstream of the exterior surface of the cylindrical wall of the atomizer housing.

15. The method according to claim 10 wherein the step of providing a liner bushing comprises making the outer sidewall of the liner bushing cylindrical, and the step of installing the liner bushing within the axial bore of the sleeve bushing comprises installing the liner bushing in a manner so as to be free of any hoop stress on the liner bushing when installed.

* * * * *